United States Patent [19]

Waugh

[11] Patent Number: 4,623,314

[45] Date of Patent: Nov. 18, 1986

[54] BOW FACING ROWING ARRANGEMENT

[76] Inventor: George B. Waugh, 337 Bogmoor Rd., Shieldhall, Glasgow, Scotland, G51 4SG

[21] Appl. No.: 705,660

[22] Filed: Feb. 25, 1985

[30] Foreign Application Priority Data

Mar. 3, 1984 [GB] United Kingdom ..... 8405623

[51] Int. Cl.[4] ..... B63H 16/04

[52] U.S. Cl. ..... 440/104; 440/105

[58] Field of Search ..... 440/104, 105, 101, 102, 440/103, 25, 32; 416/149; 114/363; 272/72

[56] References Cited

U.S. PATENT DOCUMENTS

| | | | |
|---|---|---|---|
| 185,032 | 12/1876 | Isaacs, Jr. | 440/105 |
| 269,924 | 1/1883 | Elliott | 440/105 |
| 1,381,923 | 6/1921 | Kemp | 440/105 |
| 4,052,951 | 10/1977 | Farr | 440/105 |
| 4,383,830 | 5/1983 | Cartwright | 440/105 |

FOREIGN PATENT DOCUMENTS

| | | | |
|---|---|---|---|
| 59662 | 6/1927 | Austria | 440/102 |
| 462870 | 6/1928 | Fed. Rep. of Germany . | |
| 28211 | of 1911 | United Kingdom . | |
| 304095 | 1/1929 | United Kingdom . | |
| 513510 | 10/1939 | United Kingdom . | |
| 607158 | 8/1948 | United Kingdom | 114/363 |
| 804510 | 11/1958 | United Kingdom . | |
| 2099773 | 12/1982 | United Kingdom . | |
| 2101946 | 1/1983 | United Kingdom . | |

*Primary Examiner*—Trygve M. Blix
*Assistant Examiner*—Edwin L. Swinehart
*Attorney, Agent, or Firm*—Leydig, Voit & Mayer

[57] ABSTRACT

A bow facing rowing arrangement for a boat (1) comprises an outrigger support (8) having a first pivotal connection (6) for connection of a respective oar (5) or oar support (51) to the outrigger support at or in proximity to an inboard end (16) of the oar (5). The outrigger support (8) is mounted on a base support (15) so as to be reciprocably displacable longitudinally of a boat with simultaneous pivotal movement about a generally vertical axis (10) spaced substantially from the inboard end of the outrigger support in the direction away from that in which the outrigger extends outboard of the base support (15). A foot engagement (13) connectable to the outrigger support (8) via a drive transmission (11) formed and arranged so that the effective pivotal axis P of the outrigger support (8) is substantially inboard of the actual pivotal connection (10) therebetween.

5 Claims, 4 Drawing Figures

BOW FACING ROWING ARRANGEMENT

This invention relates to rowing or paddle boats and in particular to a system of mounting oars in a boat.

Conventionally oars are pivotally mounted in rowlocks at the outermost sides of a boat or on struts substantially outboard of the boat. Thus when an oarsman pulls on the inboard ends of the oars, the oars pivot about the rowlocks so that the blades at the outboard ends move in the opposite direction (to that of the pull) to drive the boat through the water. This means that the oarsman is obliged to face in a direction opposite to that in which the boat is propelled.

In more advanced rowing boats, e.g. sculls, the propulsive force is increased by the use of a sliding seat to make use of the leg muscles in addition to the arms and upper body muscles. In this system though the additional propulsive force all has to be transmitted through the arms placing additional strain thereon. Furthermore, the movement of the mass of the oarsman, which in practice is quite substantial relative to that of the boat, in the boat results in a rather jerky movement with the boat being continually accelerated and decelerated as the oarsman moves backwards and forwards.

Another disadvantage of conventional systems is the relatively long oar length required due to the need for a substantial length of oar inboard of the pivot point thereof. Apart from an increased weight penalty, there is also the need for a relatively large waterway width to accommodate the boat and oars during rowing.

It is an object of the present invention to avoid or minimise one or more of the above disadvantages and to provide a new oar mounting system.

The present invention provides in one aspect a bow facing rowing arrangement for a boat and comprising an outrigger support means having a first pivotal connection means for connection of a respective oar or oar support to said outrigger support means at or in proximity to an inboard end of said oar, said outrigger support means being mounted on a base support means so as to be reciprocably displacable longitudinally of a boat with simultaneous pivotal movement about an effective generally vertical axis spaced substantially from the inboard end of said outrigger support means in the direction away from that in which said outrigger support means extends outboard of the base support means.

Thus the present invention allows the use of an outrigger support arrangement which to outward appearances is generally conventional and permits a relatively comfortable rowing position but through the transfer of the effective pivotal axis of the oar has the user in a bow facing position and can facilitate substantial further gains such as minimization of pitching and improved propulsion efficiency through linkage of arm and leg effort in parallel rather than in series as in convention rowing arrangements.

In a further aspect the present invention provides a bow facing rowing arrangement comprising an outrigger support means having a first pivotal connection means for connection of a respective oar or oar support to said outrigger support means at or in proximity to an inboard end of said oar but outboard of a handle portion of said oar so as to permit pivotal movement of said oar or oar support about a generally horizontal axis and foot engagement means connectable to said outrigger support means viz a drive transmission means, said outrigger support means and foot engagement means being formed and arranged to be disposable in a said boat in relation to a seating position for a rower such that said foot engagement means and seating position are reciprocably displaceable relative to each other upon bending of a rower's legs during rowing and said drive transmission means being formed and arranged so that said outrigger support means is effectively pivotable, in use of the arrangement about a generally vertical axis substantially inboard of an actual, second, pivotal connection between said outrigger support means and said drive transmission means.

Further preferred aspects of the present invention will appear from the following detailed description given by way of example of some preferred embodiments illustrated with reference to the accompanying drawings in which.

Figure 1:
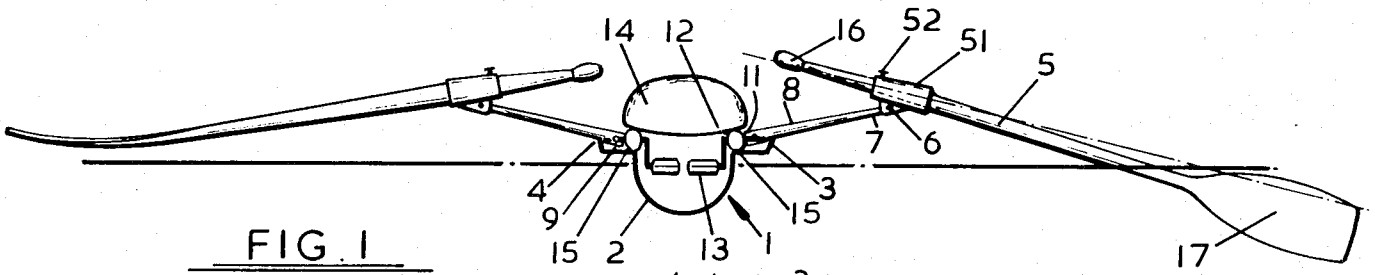
FIG. 1 is a schematic partly cut-away and elevation of a rowing boat having a rowing arrangement of the invention.

FIG. 1 shows a rowing boat 1 having a lightweight narrow hull 2 and an enlarged width cockpit 3. At each side 4 an oar 5 is pivotally mounted for pivotal movement about a horizontal axis 6 on the outboard end 7 of an outrigger support means 8. The inboard end 9 of the outrigger support means 8 is pivotally connected via a generally vertical pivot 10 to a drive transmission means 11 (described in further detail hereinbelow). At its inboard side 12 each drive transmission means 11 has connected thereto a respective foot pedal means 13 forward of a seat 14 fixed laterally centrally of and to the rear of the cockpit 3 and above the drive transmission means 11 and associated base support means 15 mounting the former and the rowing arrangement in general in the boat 1.

It will be noted from the above and the drawing that unlike in a conventional outrigger support the oar 5 can only pivot in a vertical plane. Thus any horizontal force applied to the oar 5 through its handle 16 which is as usual inboard of the oar mounting on the outrigger will be transmitted through the outrigger support 8 also so the oar no longer pivots horizontally about the oar mounting point on the outrigger but about a different point. The drive transmission means is in fact formed and arranged so as to permit reciprocal movement of the outrigger support means 8 itself together with its associated oar 5 longitudinally of the boat along the length of the elongate drive transmission and base support 11, 15 together with a progressive angular movement of the outrigger 8 and oar 5 corresponding to pivotal movement of the oar 5 about an effective pivotal axis which is well beyond the inboard end 16 of the oar 5 and well inboard of the outrigger 8 and drive transmission 11 also and is in fact on the opposite side of the centre line CL from the oar 5 (see FIGS. 2 and 3).

Figures 3, 4:
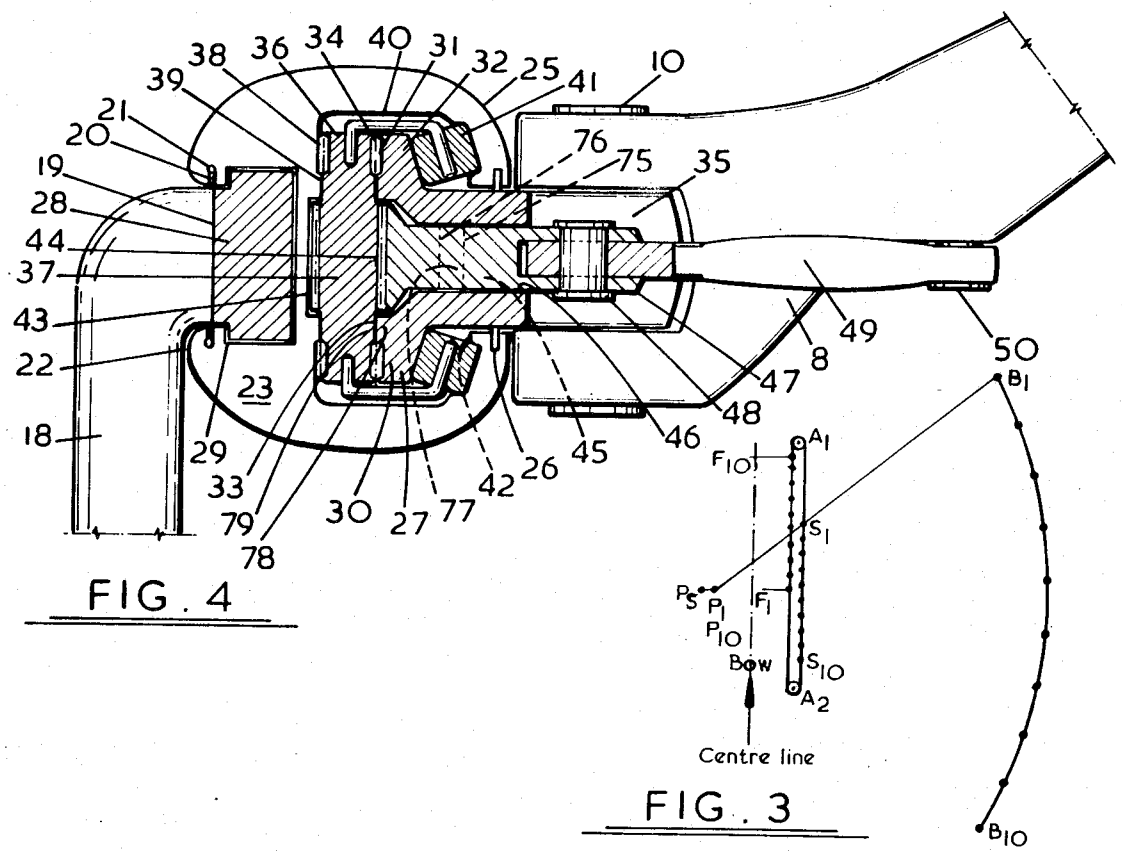
FIG. 3 is a schematic plan view illustrating relative movement of the various parts of the arrangement of FIG. 1 during a stroke.
FIG. 4 is a detail vertical section of the drive transmission and connections thereto.
Figure 6:
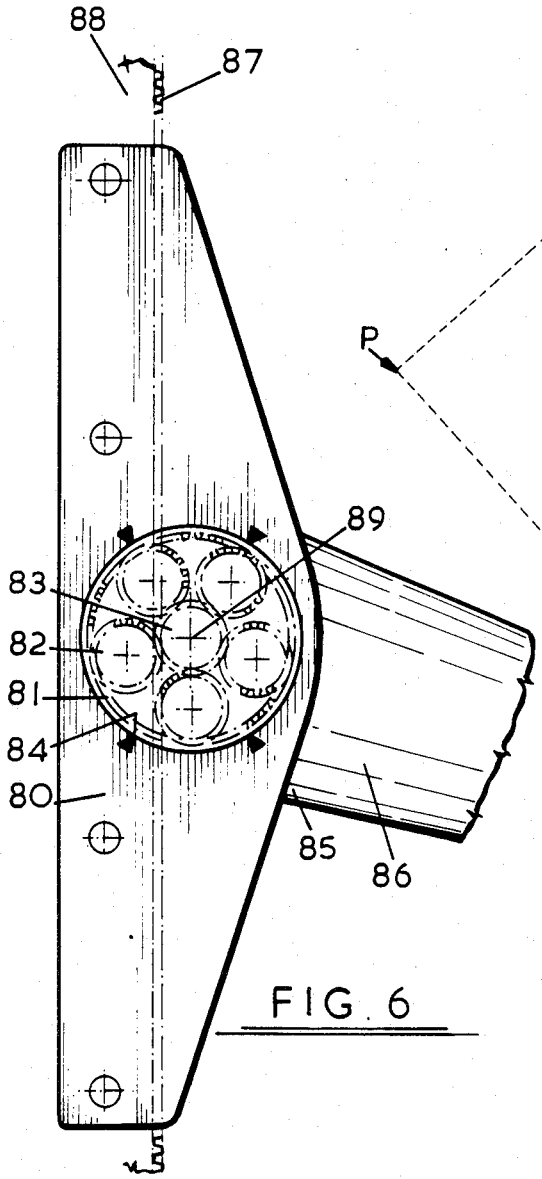
Figure 5:
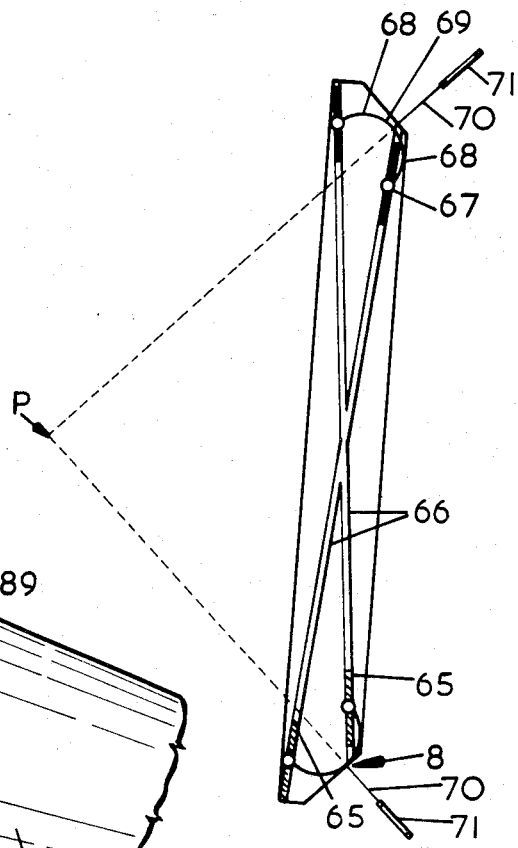

The above is indicated in part by the dashed outline representations of the beginning and end of stroke positions of the oars 5 and further by the geometrical representation of FIG. 3 in which the movements of the oar blade 17, inboard outrigger support end 9, foot pedal 13 and effective pivotal axis are indicated at ten corresponding sequential positions by $B_{1-10}$, $S_{1-10}$, and $P_{1-10}$, respectively. It will be noted that the effective pivotal axis does exhibit a limited range of movement transversely of the boat but this is so small that only some of the positions have been indicated.

It should also be noted that it is possible through choice of suitable forms of drive transmissions and relative dimensions therein to provide for greater or lesser spacing of the effective pivotal axis from the oar handle to vary the leverage thereat, relatively greater or lesser movement of the pedals with respect to the oar handles, and/or selective variation of the above during specific parts of the stroke. FIG. 4 shows one form of drive transmission 11 in which a foot pedal support bar 18 for the foot pedal 13 is secured to an elongate steel belt 19 slidably mounted with its outer edges 20 in grooves 21 extending along the inboard side 22 of an elongate member 23 housing the drive transmission and constituting a base support for the arrangement. The belt 19 extends around return pulleys 24 at each end of the member 23 and on the outboard side 25 of said member 23 is similarly slidably mounted in grooves 26 and is connected to an elongate outrigger support means shuttle 27 for transmitting longitudinal drive between the latter and the foot pedals. The foot pedal arm 18 has an enlarged head 28 which slidingly engages in a guide channel 29 so as to be freely longitudinally displacable therein whilst restraining the pedal against any lateral movement.

The outrigger shuttle 27 comprises an elongate body 30 having along the outer edges 31 of outwardly extending flanges 32 at one side 33 rack means 34 and projecting from a generally central portion on the other side a pivot pin support 35 for the vertical pivot 10 supporting the outrigger 8. The outrigger shuttle 27 is mounted on said base support elongate member 23 so that the rack means 34 of the outrigger shuttle 27 engage pinions 36 at the ends of each of a plurality of differential gear elements 37, the pinion means 36 engaging respective fixed rack means 38 provided on the back wall 39 of a chamber 40 defined inside said outboard side 25 of the elongate member 23. The shuttle 27, gear element 37 and fixed rack are held in closely meshed engagement and against lateral displacement by roller bearing means 41 acting between the flanges 32 of the shuttle and the front wall 42 of the chamber 40.

The central portion 43 of the gear element 37 has a slightly larger diameter and is also toothed for engagement with the rack 44 of a differential movement shuttle 45 which has projection extending outwardly through a slot 46 in the outrigger shuttle 27 and having at its distal end 47 a vertical link support pivot pin 48.

Figure 2:
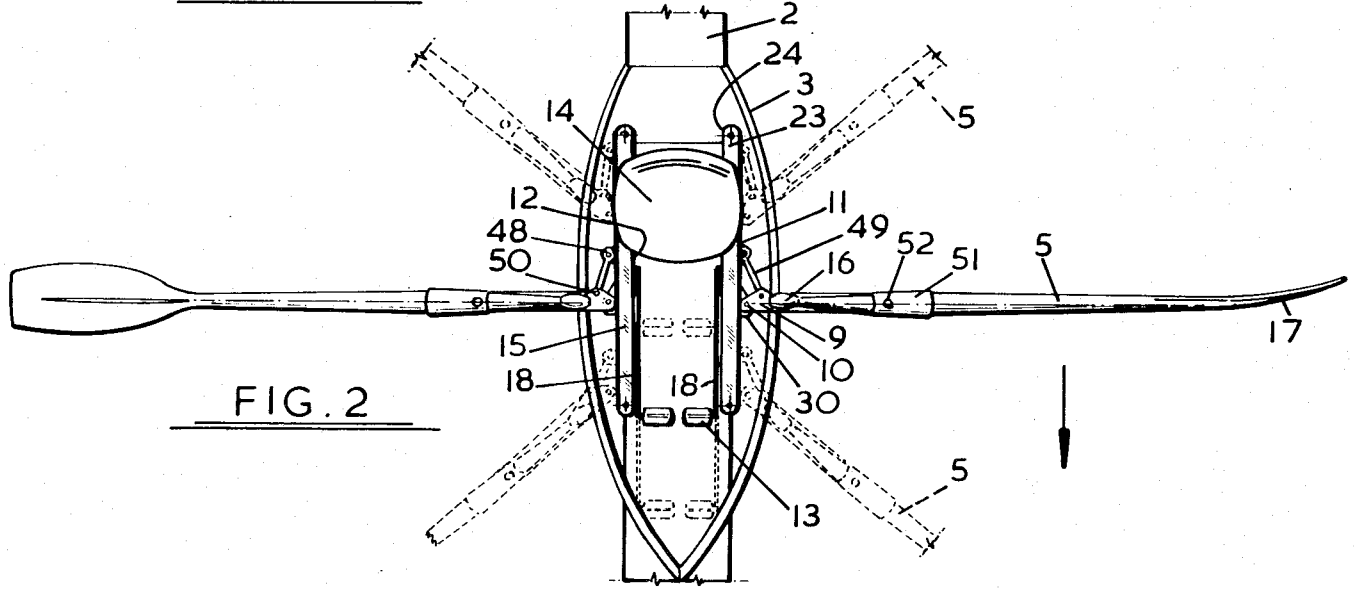
FIG. 2 is a plan view of the principal part of the boat of FIG. 1.

An elongate link 49 having one end pivotally connected by said pivot pin 48 to the differential shuttle 45 has its other end 50 pivotally connected to the outrigger 8 in proximity to but spaced from the latter's pivot pin 10 to form together therewith a deformable triangular link as may be seen best in FIG. 2. The link 49 prevents the outrigger 8 from freely pivoting around its pivot 10 and due to the differential movement of the two shuttles during movement of the outrigger longitudinally of the boat causes the outrigger to swing round progressively on its pivot 10. The rate of angular movement relative to longitudinal displacement is arranged to be such that the outrigger and hence oar effectively pivots about a point P as indicated in FIG. 3 and which as shown therein may itself vary slightly in position during the course of a stroke. The differential shuttle 45 is maintained in engagement with the toothed central portions 43 of the gear elements 37 against the forces exerted through the link 49, by means of differential roller bearings 75 disposed to act between outward faces 76 of the differential shuttle to either side of the outward projection 47 and opposed inward faces 77 of the outrigger shuttle to either side of the slot 46. It may also be noted that the gear elements 37 have cylindrical bearing surfaces 78 between the pinions 36 and central portions 43 with a diameter corresponding to that of the pinions' pitch circle, for bearing engagement with opposed bearing surfaces 79 on the outrigger shuttle 27 inwardly of the racks 34, to further positionally stabilise the outrigger shuttle and maintain proper engagement of the various gear teeth.

In order to permit feathering of the oar 5 this is rotatably mounted in a tapered sleeve—form oar support 51 secured to the outrigger, suitable pin and slot means 52 being provided between the sleeve and oar to limit rotation of the oar generally about its longitudinal axis to about 90°. As indicated by the chain line in FIG. 1 the rotational axis may be slightly asymmetrical with respect to the oar shaft to facilitate an automatic feathering of the oar.

Various modifications may be made to the above arrangement without departing from the scope of the present invention. Thus, for example, the outrigger could be made so as to bring the oar pivot 10 further inboard and/or on the hand grip of the oar could be positioned outboard of the oar pivot 10 through this would result in the need for a somewhat less usual handling of the oars. Also various other forms of outrigger mounting arrangement could be used to obtain the necessary relation between angular and longitudinal movement of the oar including for example epicylic gear means, and harmonic drive means (available from Harmonic Drive Ltd., Horsham, England), engaging suitable rack means and providing in turn alternative forms of drive transmission between the foot engagement means and the outrigger support means.

What is claimed is:

1. A rowing device suitable for use in rowing of a boat by a forward facing oarsman and comprising an outrigger means, an outrigger movement guide mechanism, and a base support means, said outrigger means having a first pivotal connection means for connection of one of a respective oar or oar support to said outrigger means, said oar having an inboard end and a handle portion, said first pivotal connection means being disposed at or in proximity to said inboard end of said oar but outboard of said handle portion of said oar and formed and arranged so as to permit pivotal movement of said oar or oar support at said first pivotal connection substantially only about a generally horizontal axis whereby application of a generally horizontal force to the oar is transmitted substantially directly through said outrigger means; and said outrigger means being mounted on said base support means to extend outwardly thereof with said movement guide mechanism acting therebetween, so as to be reciprocably displaceable longitudinally of a said boat upon application of a rowing action to said oar in use of the device, said outrigger movement guide mechanism being formed and arranged for constraining said outrigger means simultaneously to pivot about its mounting on said base support means at a rate such that said outrigger means effectively pivots about a generally vertical axis spaced substantially from the inboard end of said outrigger support means in the direction away from that in which said outrigger means extends outboard of the base support means said device also having foot engagement means and drive transmission means, said foot engagement means being drivingly connected to said outrigger means via said drive transmission means, said outrigger means and foot engagement means being formed and arranged to be disposable in a said boat with said base support means in relation to a seating position for a rower such that said foot engagement means is reciprocably displaceable relative to said seating position upon bending of a rower's legs during rowing, and upon movement of the outrigger means caused by application of a rowing action to at lease one of said oar and foot engagement means in use of the device.

2. A device according to claim 1 wherein the base support means has formed therewith an elongate guide means of the outrigger movement guide mechanism extending generally longitudinally of the boat in use thereof, and said movement guide mechanism includes first and second outrigger shuttle members mounted for guided movement along said elongate guide means and means for connecting said shuttle members to the outrigger means.

3. A device according to claim 2 wherein a first said shuttle member is pivotally connected to the outrigger means and a second said shuttle member is pivotally connected to a link means pivotally connected to the outrigger means remote from said second shuttle member, said pivotal connections forming a variable geometry triangular link, and said first and second shuttle members being mounted for movement along the guide means at different rates whereby the spacing between the pivotal connections thereto is varied thereby changing the angular disposition of said base support means.

4. A device according to claim 1 wherein is provided an oar support means formed and arranged to permit rotation of an oar supported therein in use of the device, generally about the longitudinal axis of said oar thereby to permit feathering of the oar.

5. A device according to claim 4 when mounted in a boat.

* * * * *